US009307799B2

(12) United States Patent
Heard

(10) Patent No.: US 9,307,799 B2
(45) Date of Patent: Apr. 12, 2016

(54) SELF-TIGHTENING HAT

(71) Applicant: Darrell Heard, Seminole, FL (US)

(72) Inventor: Darrell Heard, Seminole, FL (US)

( * ) Notice: Subject to any disclaimer, the term of this patent is extended or adjusted under 35 U.S.C. 154(b) by 310 days.

(21) Appl. No.: 13/956,818

(22) Filed: Aug. 1, 2013

(65) Prior Publication Data

US 2015/0033444 A1 Feb. 5, 2015

(51) Int. Cl.
*A42B 1/22* (2006.01)
*A42B 1/06* (2006.01)

(52) U.S. Cl.
CPC .. *A42B 1/22* (2013.01); *A42B 1/064* (2013.01)

(58) Field of Classification Search
CPC ..... A42B 1/064
USPC ..... 2/195.7, 209.12
See application file for complete search history.

(56) References Cited

U.S. PATENT DOCUMENTS

| | | | | |
|---|---|---|---|---|
| 2,648,847 | A * | 8/1953 | Crowder | 2/195.5 |
| 4,268,918 | A * | 5/1981 | Lee | 2/172 |
| 4,777,667 | A * | 10/1988 | Patterson et al. | 2/195.5 |
| 5,253,364 | A * | 10/1993 | Robinson | 2/10 |
| 5,742,944 | A * | 4/1998 | Pfefferman | 2/209.12 |
| 7,082,618 | B1 * | 8/2006 | Muso | 2/175.1 |
| 2011/0283441 | A1 * | 11/2011 | Orman | 2/195.7 |

* cited by examiner

*Primary Examiner* — Katherine Moran
(74) *Attorney, Agent, or Firm* — Maxey Law Offices, PLLC; Stephen Lewellyn

(57) ABSTRACT

A hat, comprising a brim support defining an aperture, a brim cover attached to the brim support for movement in a direction toward and away from the aperture between a first position where the aperture is closed by the brim cover and a second position where the aperture is open, and a tightening strap operatively connected to the brim cover and being tensioned when the brim cover moves from said first position to said second position.

18 Claims, 10 Drawing Sheets

SELF-TIGHTENING HAT

FIELD OF THE INVENTION

The present invention relates generally to hats, and more particularly, relating to a hat that is self-tightening to resist undesired removal from the wearers head due to wind.

BACKGROUND OF THE INVENTION

Hats often include a brim that protrudes horizontally from a portion of the hat to shield a wearer from sun or rain. For the best sun and rain blocking, brims are generally formed from a solid material. Because brims are formed from a solid material, they have a tendency to retain air below the lower face of the brim which can force the hat from the wearer's head.

Hats with brims are generally available in multiple sizes or are adjustable for the size of the wearer's head to ensure a proper fit. A properly fitted hat with a brim resists being blown off of the user's head in a slight wind, but does not resist a fast moving stream of air such as high winds or when the wearer is exposed to the air while using a form of conveyance. If a hat with a brim were to be worn tight enough to resist a fast moving stream of air, it would become uncomfortable for the wearer within a short period of time, if not immediately.

To counteract the tendency of a hat with a brim to blow off of a user's head in a fast moving stream of air, various designs have been used. Several of the designs have permanent air gaps in the brim to allow for the movement of air through the brim. Other designs utilize a flap which can be moved by the air below the brim to open a channel for evacuation of the air. These designs are improvements over a solid brim, but as the stream of air increases in velocity, the capacity of the openings will be overcome and the hat will still be blown from the user's head.

While the devices heretofore fulfill their respective, particular objectives and requirements, they do not provide a self-tightening hat with a brim. As such there exists a need for a self-tightening hat with a brim, which substantially departs from the prior art, and in doing so provides an apparatus primarily developed for the purpose of remaining on the head of a wearer in a fast moving stream of air.

SUMMARY OF THE INVENTION

In view of the foregoing disadvantages inherent in the known types of hats with brims including brim arrangements for releasing air through the brim now present in the prior art, the present invention provides a new brim and tightening strap construction wherein the same can be used for tightening the ball cap on the wearer's head in the presence of a fast moving stream of air.

In accordance with the present invention, an apparatus for tightening a hat with a brim on the wearer's head, allows the hat to be worn in a comfortable fit under normal circumstances while automatically adjusting to stay on the wearer's head in the presence of a high velocity stream of air.

In general, in one aspect, a hat is provided. The hat includes a brim support defining an aperture, a brim cover attached to the brim support for movement in a direction toward and away from the aperture between a first position where the aperture is closed by the brim cover and a second position where the aperture is open, and a tightening strap operatively connected to the brim cover and being tensioned when the brim cover moves from said first position to said second position.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 2:
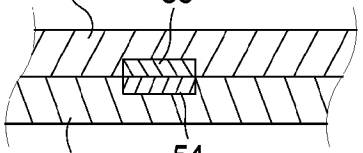
FIG. 2 is a partial, cross-sectional view taken along line 2-2 in FIG. 1, showing a magnet catch.
Figure 1:
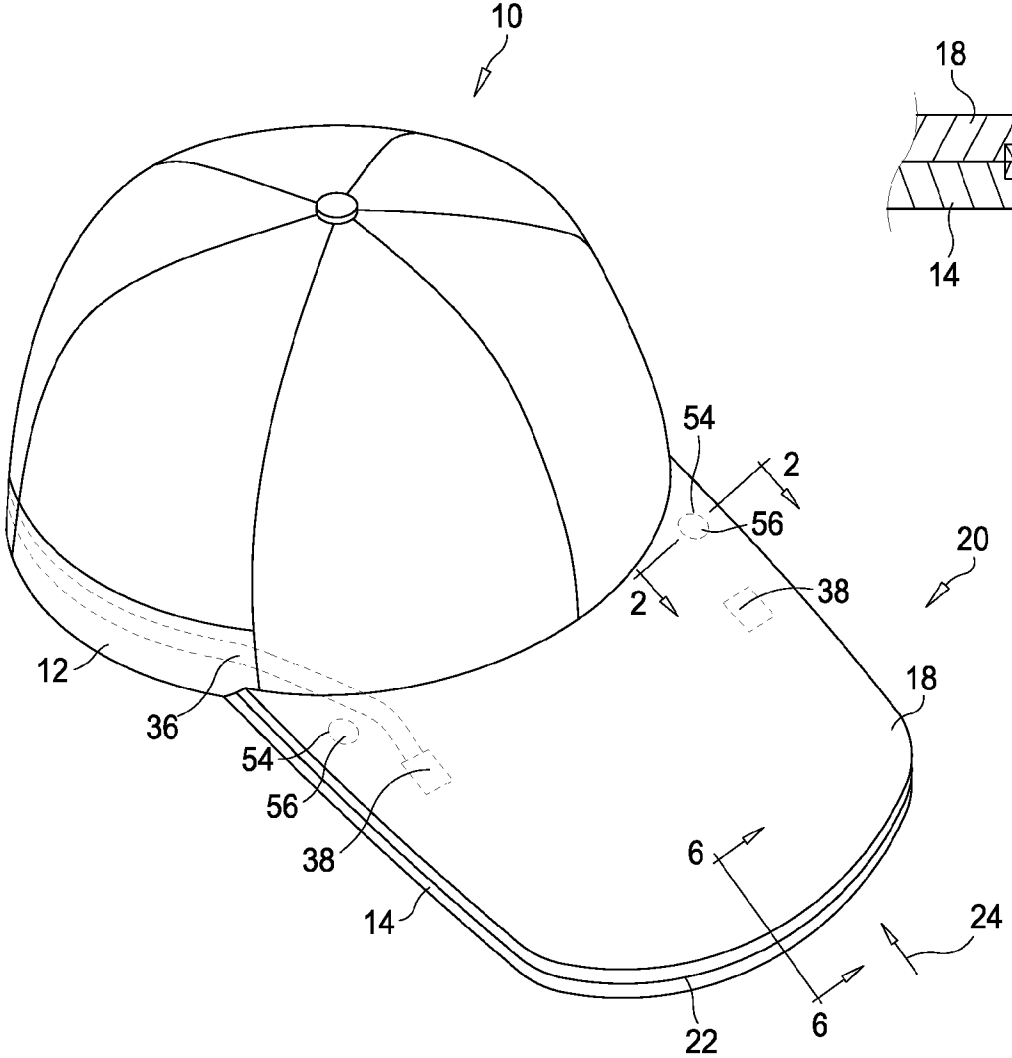
FIG. 1 is an upper, front perspective view of a self-tightening hat constructed in accordance with the principles of an embodiment of the present invention.
Figure 3:
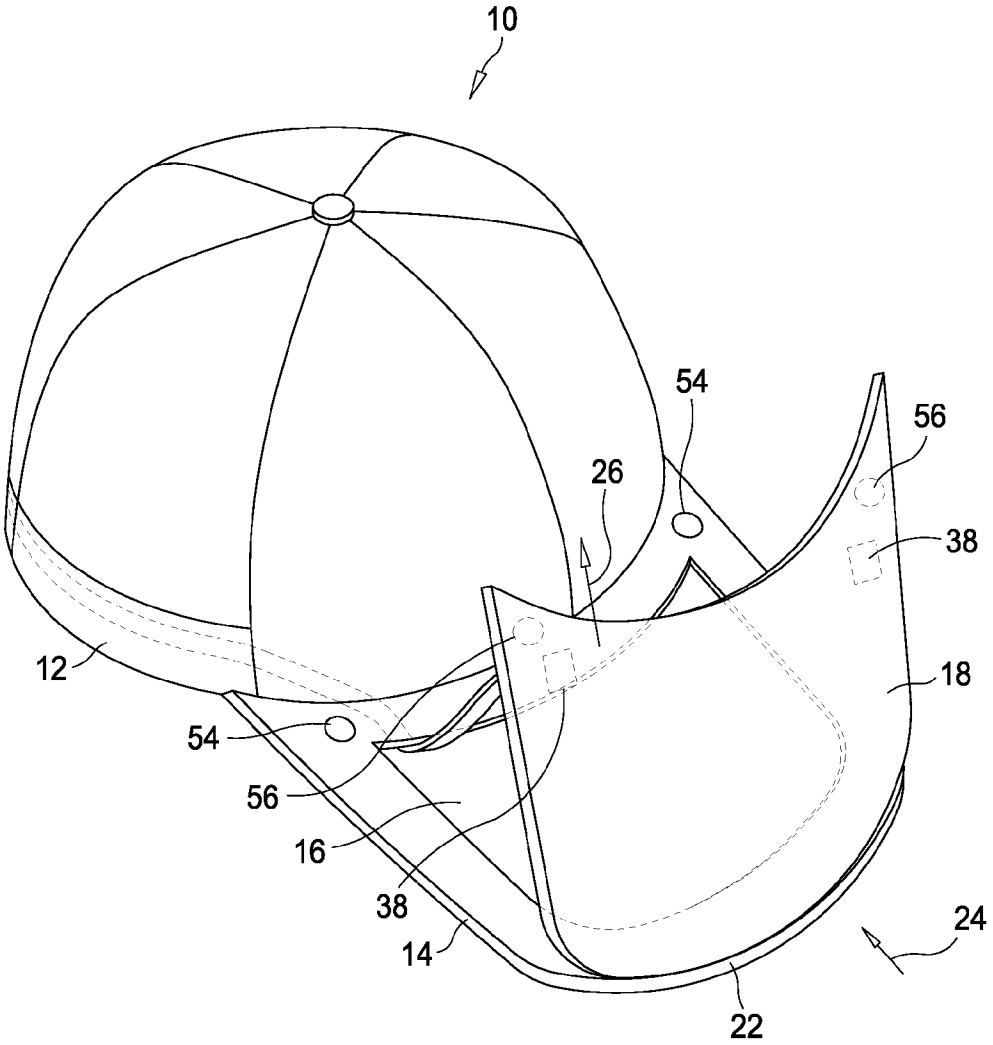
FIG. 3 is an upper, front perspective view of the self-tightening hat of FIG. 1, illustrating a brim in a tightening position.
Figure 4:
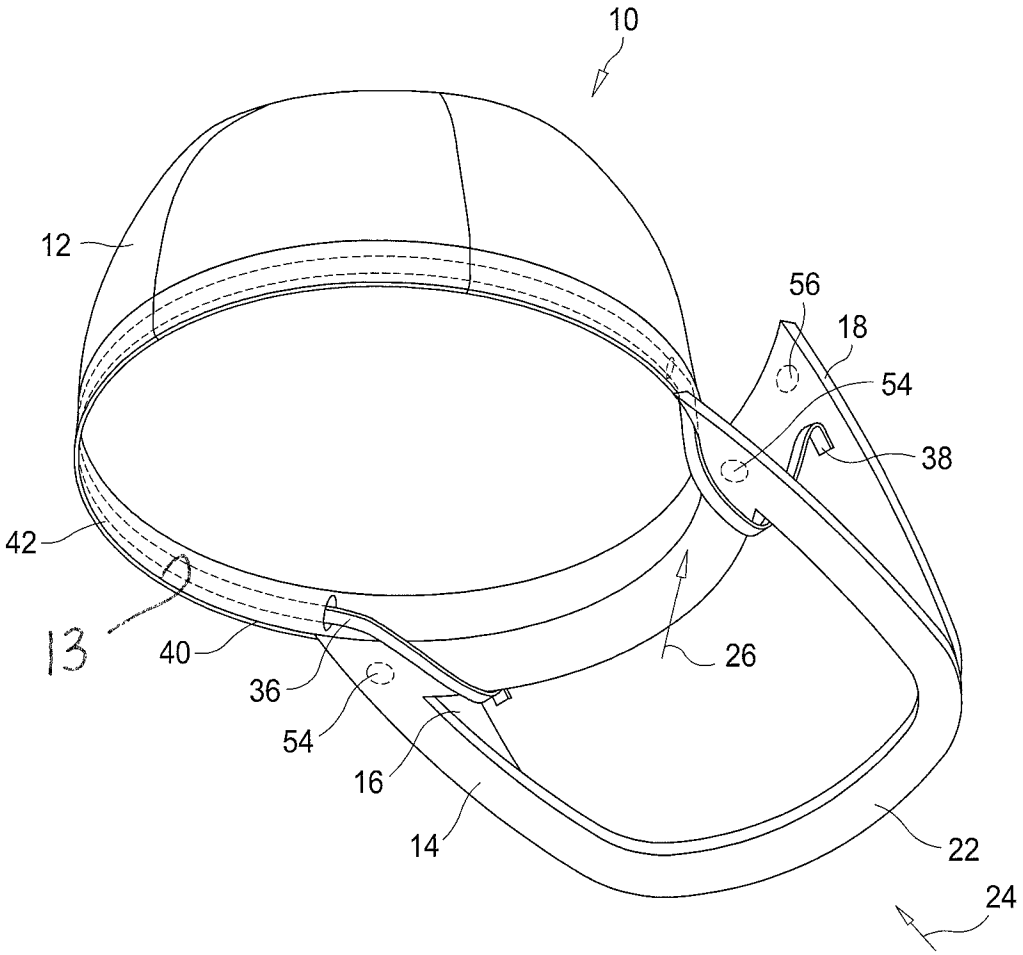
FIG. 4 is a lower, rear perspective view of the self-tightening hat of FIG. 1, illustrating the brim in a tightening position.
Figure 5:
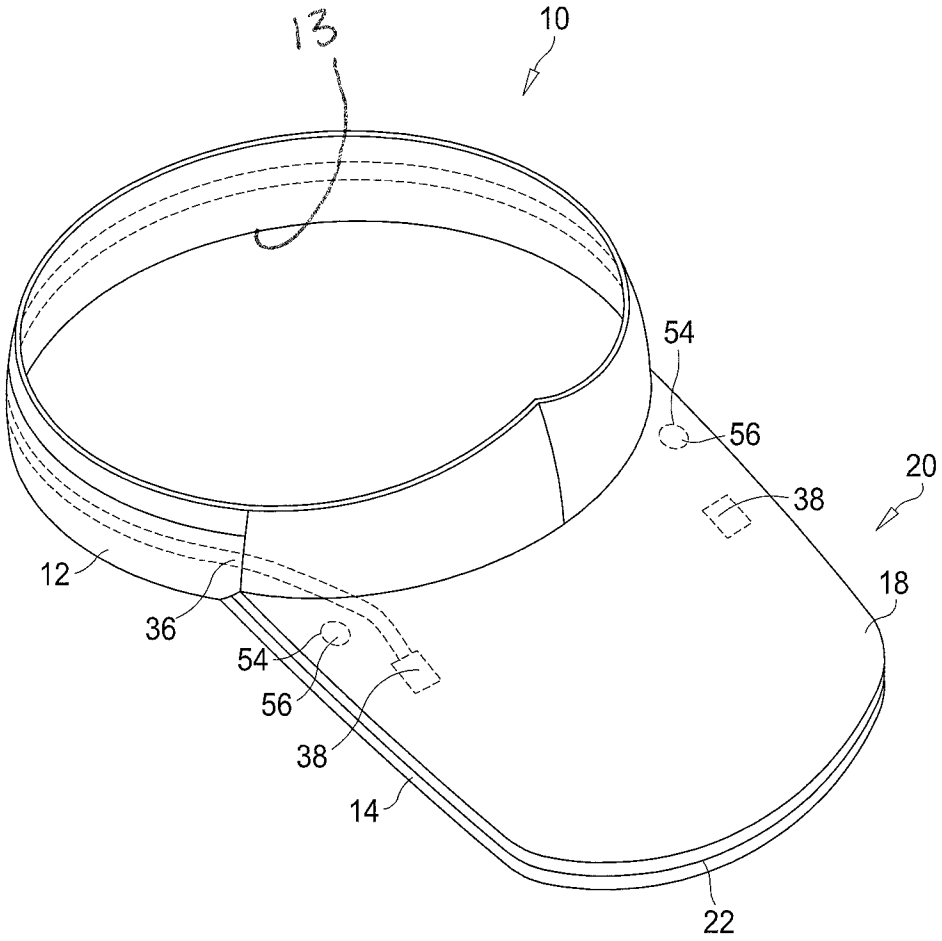
FIG. 5 is an upper front perspective view of a self-tightening hat constructed in accordance with the principles of an another embodiment of the present invention.
Figure 7:
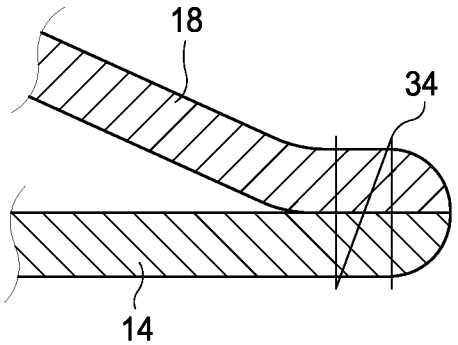
FIG. 7 is a partial, cross-sectional view taken along line 6-6 in FIG. 1, showing stitching.
Figure 6:
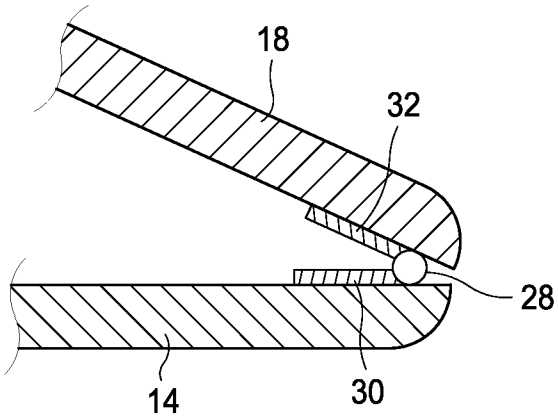
FIG. 6 is a partial, cross-sectional view taken along line 6-6 in FIG. 1, showing a hinge.
Figure 8:
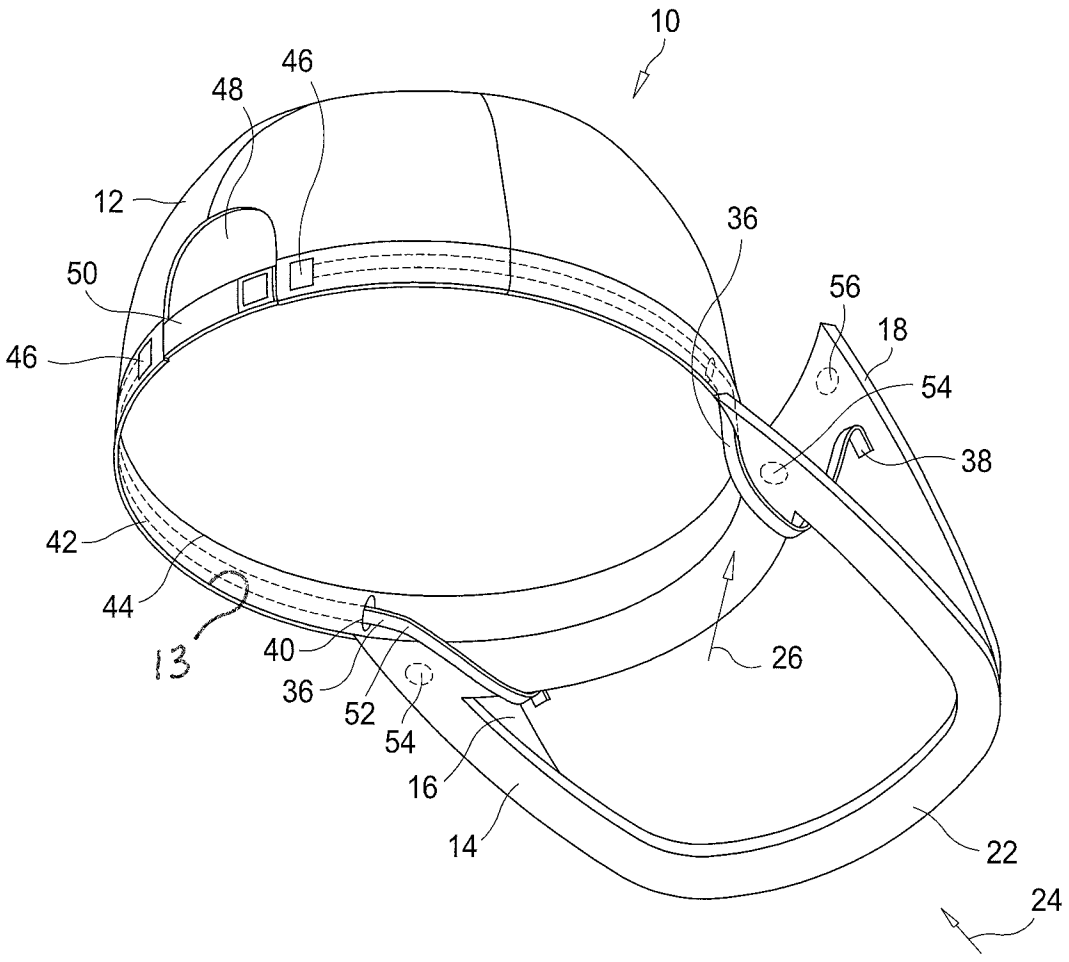
FIG. 8 is a lower, rear perspective view of the self-tightening hat with brim, illustrating the brim tilted in a tightening position.
Figure 9:
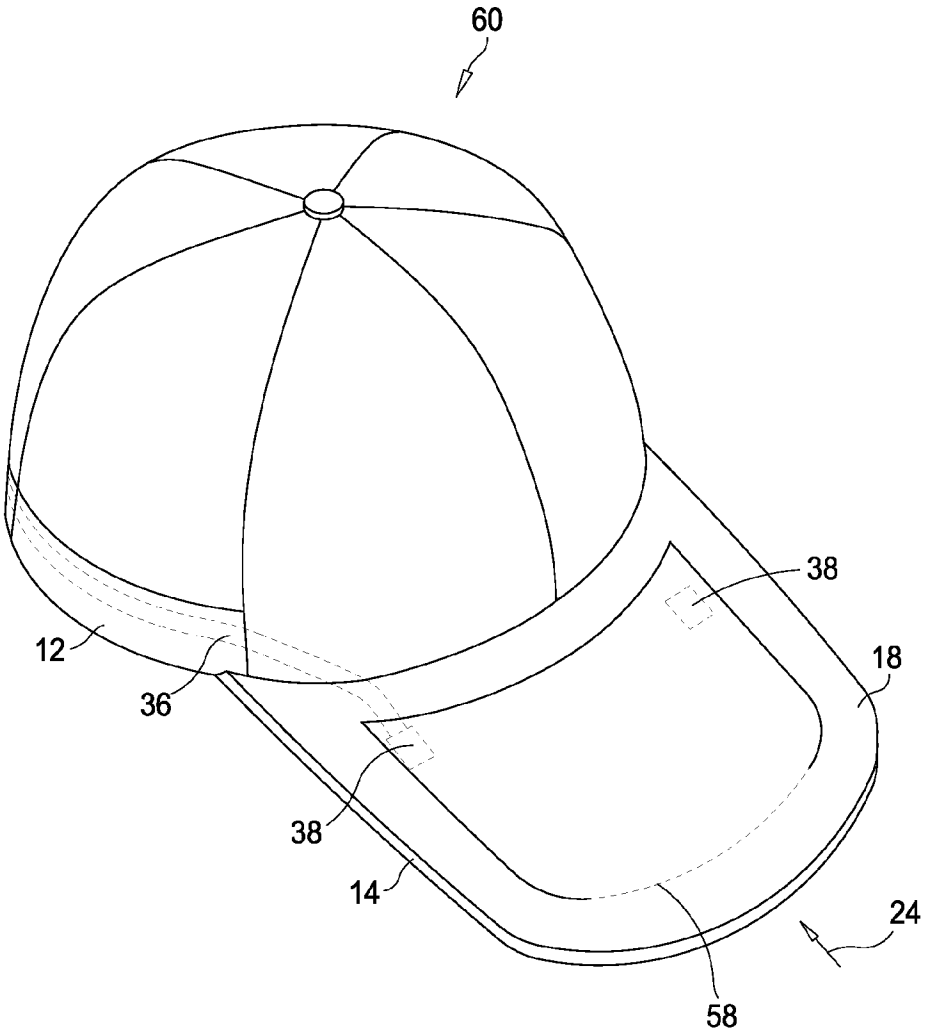
FIG. 9 is an upper, front perspective view of a self-tightening hat constructed in accordance with the principles of another embodiment of the present invention.
Figure 10:
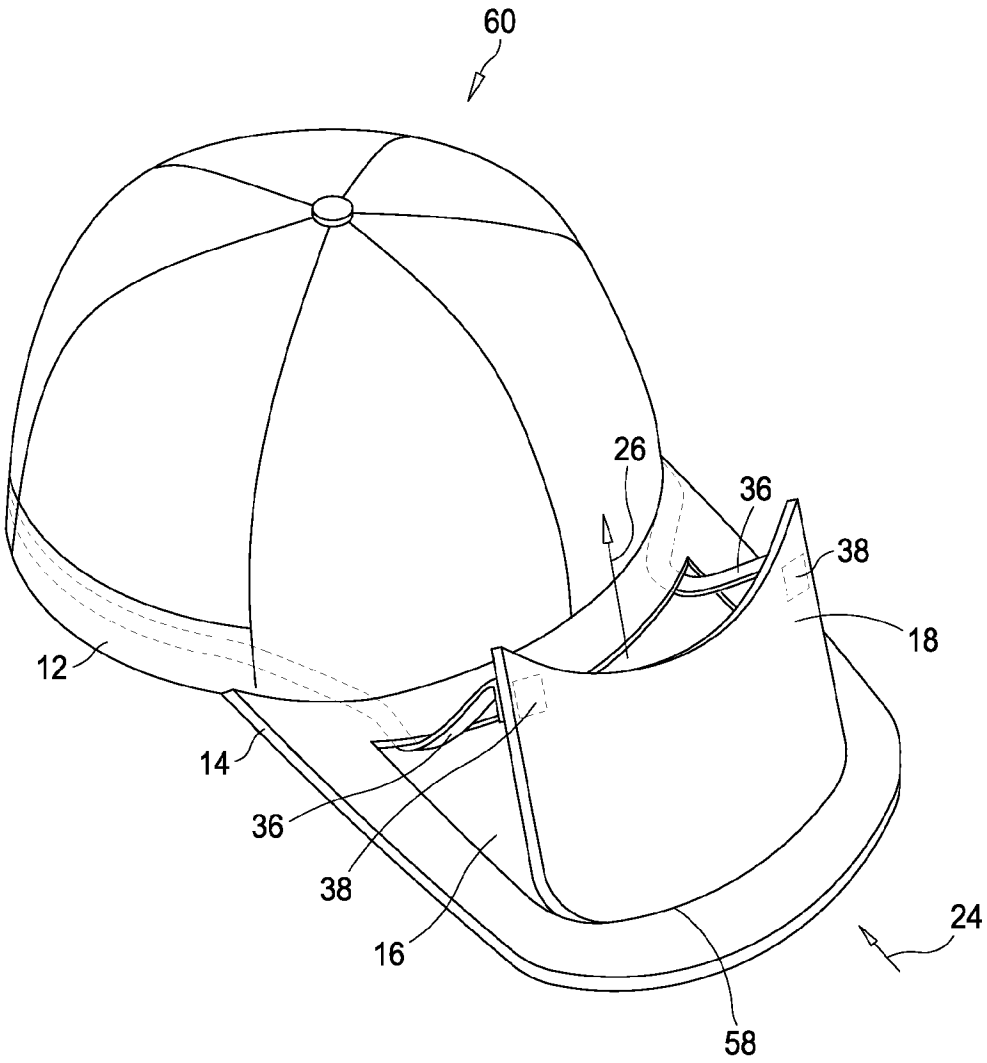
FIG. 10 is an upper, front perspective view of the self-tightening hat of FIG. 9, illustrating a brim in a tightening position.
Figure 12:
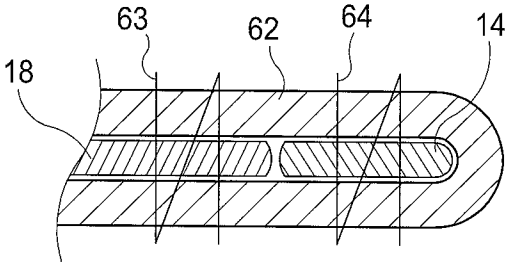
FIG. 12 is a partial, cross-sectional view taken along line 12-12 of FIG. 11, showing a fabric connection.
Figure 11:
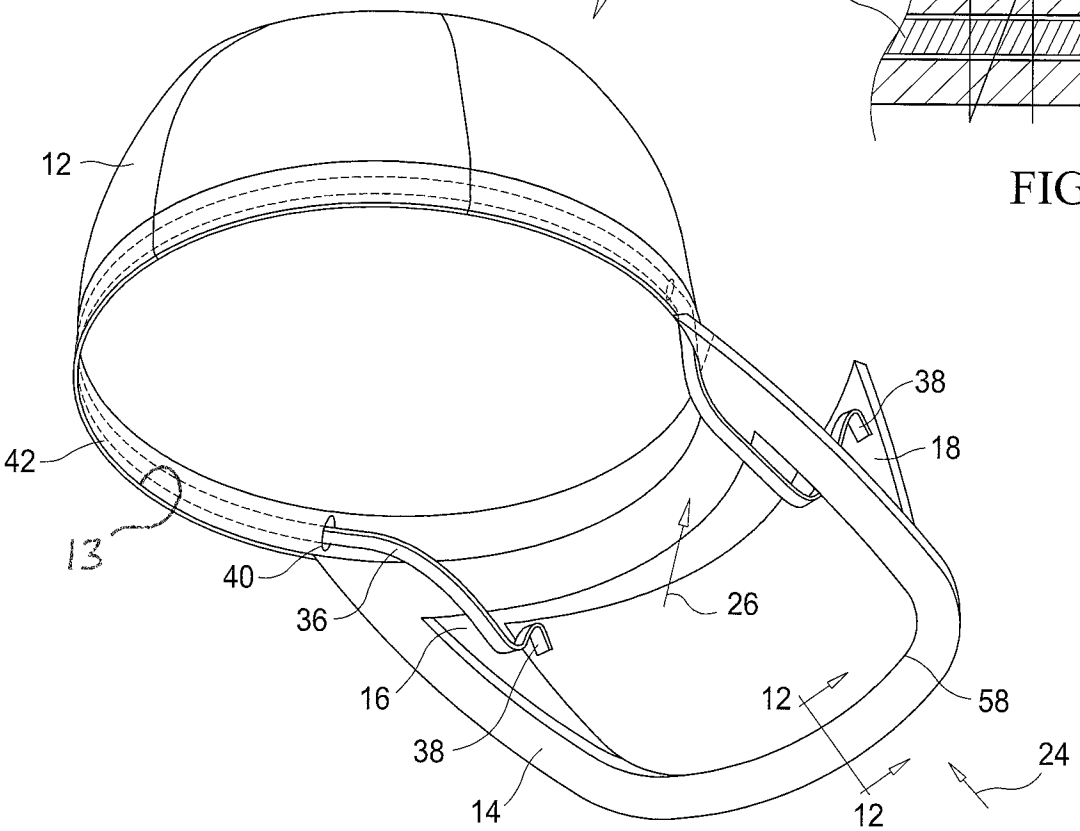
FIG. 11 is a lower, rear perspective view of the self-tightening hat of FIG. 9, illustrating the brim in a tightening position.
Figure 14:
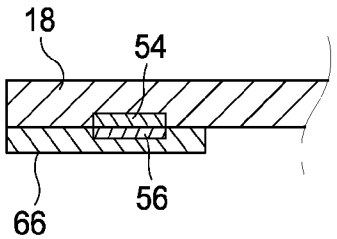
FIG. 14 is a partial, cross-sectional view taken along line 14-14 in FIG. 13, showing the optional magnet catch.
Figure 13:
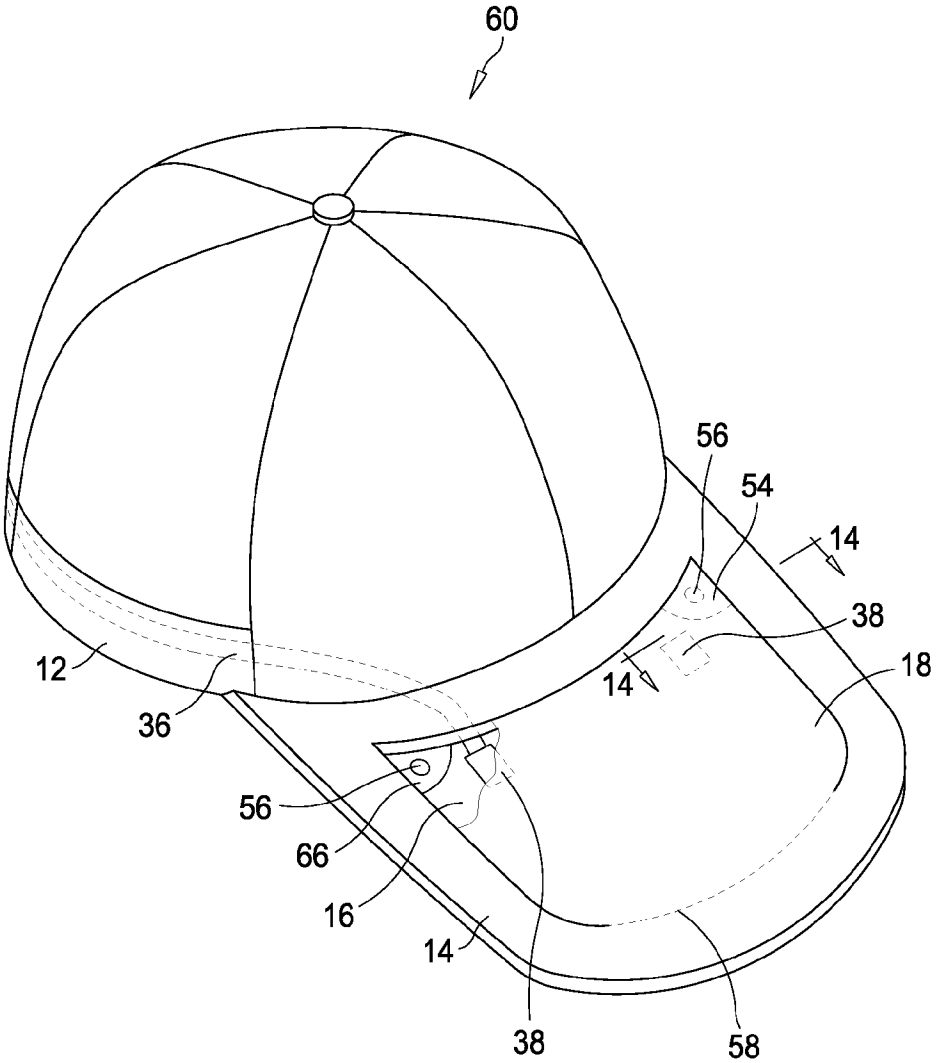
FIG. 13 is a upper, front perspective view of the self-tightening hat of FIG. 9, showing the optional magnet placement.

Initially, with reference to FIGS. 1 through 8, there is representatively illustrated a new self-tightening hat 10 constructed in accordance with an embodiment of the present invention. The self-tightening hat 10 includes a body 12 having a circular opening 13 that encircles a wearer's head in a conventional manner. As a non-limiting example, body 12 may take the form of a ball cap (as shown in FIG. 1) or a visor (as shown in FIG. 5). A brim support 14 is attached to and extends forwardly from the body 12. The brim support 14 defines an aperture 16 which may be formed wholly within the brim support 14 or may be formed by a combination of the brim support 14 and the body 12. The aperture 16 may also be more than one opening formed in the brim support 14 or by the brim support 14 in combination with the body 12.

The brim support 14 has a brim cover 18 affixed thereto. Together, the brim support 14 and the brim cover 18 form a brim 20. The brim cover 18 is substantially the same size as the brim support 14 and is affixed near the forward edge 22 of the brim support 14. When the brim cover 18 is placed over the brim support 14, it covers the aperture 16. The brim cover 18 may be affixed to the brim support 14 in any manner known in the art which allows for the brim cover 18 to move in a tilting motion relative to the brim support 14, thereby uncovering the aperture 16. The brim support 14 may be, but need not be, rigid during the tilting motion of the brim cover 18. The brim support 14 may bend to facilitate the tilting motion of the brim cover 18. Bending of the brim support 14 will generally be a function of the elasticity of the material forming the brim support 14.

The brim cover 18 may be affixed through the use of a hinge 28 where a bottom portion of the hinge 30 is connected to the brim support 14 and an upper portion of the hinge 32 is connected to the brim cover 34. The brim cover 18 may also be affixed to the brim support 14 with a thread 34 stitched through both the brim cover 18 and the brim support 14. The thread 34 may be manufactured from any material known in the art. The thread 34 may be stitched using any technique known in the art.

At least one tightening strap 36 is attached to the brim cover 18 through at least one brim end 38 of the at least one tightening strap 36. Several strands of material may be run in parallel and considered as a single tightening strap 36. In the case of a single tightening strap 36, it is preferred that the single tightening strap 36 be of a proper length to follow along the curvature of the body 12 and be attached to the brim cover 18 through two brim ends 38 of the single tightening strap. It is further preferred that the single tightening strap 36 enter through a tightening strap opening 40 and travel at least part of the distance around the circumference of the body 12 along the circular opening 13 of the hat 10 and through a tightening strap channel 42. The tightening strap channel 42 may be fully enclosed or may be partially open, such as an open channel top 44.

Alternatively embodiments incorporating only one tightening strap 36, may have one brim end 38 attached to the brim cover 18 and a body end 46 attached to the body 12. It is preferred that the single tightening strap 36 enter through a tightening strap opening 40 and travel at least part of the distance around the circumference of the body 12 through a tightening strap channel 42. The tightening strap channel 42 may be fully enclosed or may be partially open, such as an open channel top 44.

In embodiments which incorporate more than one tightening strap 36, each tightening strap will include a brim end 38 and a body end 46. The brim end 38 of each tightening strap 36 will be attached to the brim cover 18 and the body end 46 will be attached to body 12. It is preferred that the tightening straps 36 enter through a tightening strap opening 40 and travel at least part of the distance around the circumference of the body 12 through a tightening strap channel 42. The tightening strap channel 42 may be fully enclosed or may be partially open, such as an open channel top 44.

Some embodiments of the present invention will include a resizing space 48 which allows the hat to be resized to fit a plurality of head sizes. Embodiments incorporating a resizing space 48 will normally include a resizing element 50 near the bottom of the resizing space 48. The resizing element 50 may be any type of resizing element known in the art, such as a Velcro fastener, buckled fastener, locking fastener, cinching fastener, or a plurality of protrusions and plurality of holes. In embodiments incorporating a resizing space 48, it is preferred that the at least one tightening strap 36 not continue around the body 12 past the resizing space 48. Instead, it is preferred that the tightening strap 36 include a brim end 38 and a body end 46 and that the body end 46 be attached to the body 12 at a point along the circumference of the body 12 between the entrance point 52 where the tightening strap 36 enters within the space of the body 12 and the location of the resizing space 48.

The brim support 14 may optionally include one or more magnets 54. In embodiments incorporating one or more magnets 54, the brim cover 18 will preferably include one or more metallic elements 56. The inverse may also be optionally used, where the brim support 14 includes one or more metallic elements 56 and where the brim cover 18 includes one or more magnets 54.

In operation, when air flows in a rearward direction 24 towards the brim 20, pressure builds below the brim 20. When sufficient pressure builds up below the brim 20, the brim cover 18 moves away from the brim support 14 and aperture 16 on one side in a tilting motion. The tilting motion of the brim cover 18 uncovers the aperture 16 and allows air to flow through the aperture 16 in an upward direction 26. The tilting motion of the brim cover 18 pulls the brim end 38 of the one or more tightening straps 36. In embodiments incorporating only one tightening strap 36 with two brim ends 38, the tightening strap tightens around the wearer's head and increases the resistance to the hat 10 being blown off the wearer's head by a fast moving stream of air. In embodiments incorporating more than one tightening strap 36 including both brim ends 38 and body ends 46, the tightening straps 36 pull the rear of the body 12 in a forward direction towards the brim 20 whereby the tightening straps 36 tighten the body 12 around the wearer's head and increases the resistance to the hat 10 being blown off the wearer's head by a fast moving stream of air.

The one or more magnets 54 and the one or more metallic elements 56, regardless in which arrangement, function to latch the brim cover 18 to the brim support 14. The one or more magnets 54 must, however, have a low enough attraction to the metallic elements 56 that they do not impair the functioning of the brim cover 18 to tiltably move a sufficient amount so as to uncover the aperture 16 in the brim support 14 in the presence of a fast moving stream of air.

In FIGS. 9-13 self-tightening hat 60 constructed in accordance with another embodiment of the present invention is illustrated, wherein the same reference numbers refer to elements previously discussed. In this embodiment, self-tightening hat 60 includes a brim cover 18 which is substantially the same size and shape as the aperture 16. The brim cover 18 is affixed to the brim support 14.

The brim cover 18 may be affixed to the brim support 14 in any manner known in the art which allows for the brim cover 18 to move in a tilting motion relative to the brim support 14. The brim cover 18 will preferably be affixed at the forward edge 58 of the aperture 22. The brim cover 18 may be affixed through the use of fabric 62 which is affixed around both the brim cover 18 and the brim support 14. The fabric 62 may be affixed to the brim cover 18 with a first thread 63 stitched through both the brim cover 18 and the fabric 62. The fabric 62 may be affixed to the brim support 14 with a second thread 64 stitched through both the brim support 14 and the fabric 62. The first thread 63 and the second thread 64 may be manufactured from any material known in the art. The first thread 63 and the second thread 64 may optionally be the same thread rather than two distinct threads. The first thread 63 and the second thread 64 may be stitched using any technique known in the art.

The self-tightening hat 10 of this embodiment will include at least one tightening strap 36 with all of the advantages, features and limitations described above for other embodiments of the self-tightening hat 10.

The brim support 14 may optionally include one or metallic elements 56. In embodiments incorporating one or more metallic elements 56, the brim cover 18 will preferably include one or more magnets 54. The inverse may also be optionally used, where the brim support 14 includes one or more magnets 54 and where the brim cover 18 includes one or more metallic elements 56. The brim support may further include a brim cover stop 66 which may also optionally include the metallic elements 56 or the magnets 54. The brim cover stop 66 will ideally be situated below the brim support so when the brim cover 18 rests on the brim cover stop 66, the brim cover 18 and the brim support 14 will be substantially aligned.

In operation, when air flows in a rearward direction 24 towards the brim 20, pressure builds below the brim 20. When sufficient pressure builds up below the brim 20, the brim cover 18 moves away from the brim support 14 and aperture 16 on one side in a tilting motion. The tilting motion of the brim cover 18 uncovers the aperture 16 and allows air to flow through the aperture 16 in an upward direction 26. The tilting motion of the brim cover 18 pulls the brim end 38 of the one or more tightening straps 36. In embodiments incorporating only one tightening strap 36 with two brim ends 38, the tightening strap tightens around the wearer's head and increases the resistance to the hat 10 being blown off the wearer's head by a fast moving stream of air. In embodiments incorporating more than one tightening strap 36 including both brim ends 38 and body ends 46, the tightening straps 36 pull the rear of the body 12 in a forward direction towards the brim 20 whereby the tightening straps 36 tighten the body 12 around the wearer's head and increases the resistance to the hat 10 being blown off the wearer's head by a fast moving stream of air.

The one or more magnets 54 and the one or more metallic elements 56, regardless in which arrangement, function to latch the brim cover 18 to the brim support 14. The one or more magnets 54 must, however, have a low enough attraction to the metallic elements 56 that they do not impair the functioning of the brim cover 18 to tiltably move a sufficient amount so as to uncover the aperture 16 in the brim support 14 in the presence of a fast moving stream of air.

A number of embodiments of the present invention have been described. Nevertheless, it will be understood that various modifications may be made without departing from the spirit and scope of the invention. Accordingly, other embodiments are within the scope of the following claims.

What is claimed is:

1. A hat, comprising:

a body having a circular opening;

a brim support attached to and extending from said body, said brim support defining an aperture;

a brim cover attached to said brim support for movement in a direction toward and away from said aperture between a first position where said aperture is closed by said brim cover and a second position where said aperture is open; and at least one tightening strap extending around the circumference of said circular opening of said body and operatively connected to said brim cover and being tensioned when said brim cover moves from said first position to said second position to tighten said body about a wearer's head.

2. The hat of claim 1, wherein the hat is a ball cap.

3. The hat of claim 1, wherein the hat is a visor.

4. The hat of claim 1, wherein said at least one tightening strap is elastic.

5. The hat of claim 1, wherein said brim cover is affixed to said brim support with a hinge.

6. The hat of claim 1, wherein said brim cover is affixed to said brim support with stitching.

7. The hat of claim 1, wherein said brim cover is affixed to said brim support with fabric.

8. The hat of claim 1, wherein said brim support further comprises a magnet and said brim cover further comprises a metallic element.

9. The hat of claim 1, wherein said brim cover further comprises a magnet and said brim support further comprises a metallic element.

10. The hat of claim 1, wherein said at least one tightening strap comprises a single elongated tightening strap.

11. The hat of claim 10, wherein said single elongated tightening strap comprises two ends wherein said two ends are affixed to said brim cover in such a manner as to form an aperture for receiving the head of the wearer.

12. The hat of claim 1, wherein said at least one tightening strap comprises two elongated tightening straps.

13. The hat of claim 12, wherein said two elongated tightening straps each comprise a brim end and a body end wherein each of said brim ends are affixed to said brim cover and each of said body ends are affixed on a rearward portion of said body.

14. The hat of claim 1, wherein said brim cover substantially covers said brim support.

15. The hat of claim 1, wherein said brim cover substantially fills said aperture.

16. The hat of claim 15, wherein said brim support is aligned with said brim cover.

17. A self-tightening hat comprising:

a body having a circular opening that is adapted to encircle a wearer's head;

a brim support attached to and extending from said body, said brim support defining an aperture;

a brim cover attached to said brim support for movement in a direction toward and away from said aperture between a first position where said aperture is closed by said brim cover and a second position where said aperture is open, wherein said brim cover is adapted to be moved between said first and said second positions by a force of air across said brim cover; and at least one tightening strap extending around the circumference of said circular opening of said body and operatively connected to said brim cover and being tensioned when said brim cover moves from said first position to said second position causing said body to be tighten about a wearer's head.

18. The self-tightening hat of claim 17, wherein said at least one tightening strap comprises two elongated tightening straps, each having a brim end and a body end wherein each of said brim ends are affixed to said brim cover and each of said body ends are affixed on a rearward portion of said body.

* * * * *